US006179687B1

(12) United States Patent
Lee et al.

(10) Patent No.: US 6,179,687 B1
(45) Date of Patent: Jan. 30, 2001

(54) UNDERGARMENTS WITH INVISIBLE STRAP

(76) Inventors: Elena Lee; Judy Lu, both of 365 S. Atlantic Blvd., Ste. C, Monterey Park, CA (US) 91754

( * ) Notice: Under 35 U.S.C. 154(b), the term of this patent shall be extended for 0 days.

(21) Appl. No.: 09/524,136

(22) Filed: Mar. 10, 2000

(51) Int. Cl.[7] ..... A41C 3/00
(52) U.S. Cl. ..... 450/88; 450/1; 2/67
(58) Field of Search ..... 450/82.88; 2/67, 2/69, 1, 326, 327–331

(56) References Cited

U.S. PATENT DOCUMENTS 1,687,592 * 10/1928 Rothstein ..... 450/86
2,109,345 * 2/1938 Silverman ..... 450/86
2,657,392 * 11/1953 Jackson ..... 450/86
2,849,723 * 9/1958 Marino ..... 450/86
3,311,112 * 3/1967 Murray ..... 450/86
3,334,632 * 8/1967 Rashkin ..... 450/86

* cited by examiner

*Primary Examiner*—Gloria M. Hale
(74) *Attorney, Agent, or Firm*—Maria Erlinda Co Sarno

(57) ABSTRACT

The invention provides a thin, barely visible to invisible strap particularly useful for imparting invisibility without sacrificing the support imparted by such straps on underwears suitable for use on clothing of transparent material or on backless, strapless, and sleeveless clothing. The strap is made of a thin, clear, colorless, polyurethane material having the desired elasticity, flexibility and softness of a strap while providing sufficient support to the cups thereby preventing the breasts from sagging.

20 Claims, 8 Drawing Sheets

UNDERGARMENTS WITH INVISIBLE STRAP

BACKGROUND

The invention relates to a barely visible to nearly invisible undergarment strap, preferably applied to ladies' brassieres, suitable for wear underneath clothing of transparent or lace material and on strapless, backless, and sleeveless clothing. A brassiere is also referred to herein as bra. Conventional straps for underwears are made of textile material which may or may not be elastic. These straps on undergarments post aesthetic problems when worn underneath clothing of transparent material because it is visible and thus, loses the elegance of the clothing especially on formal wears and wedding gowns. It is also unsightly, distracting and embarrassing when they become loose and slide over the person's shoulder especially when wearing sleeveless clothing. The wearing of clothing with straps, however, is necessary for most people because clothing like brassieres, tank tops, chemise, camisole, summer wear and some swimsuits are everyday wear items. This problem has resulted in the use of different forms of strap restraining devices. Strap restraining devices only works on some occasions because it needs some room on the clothing's strap for its installation. Therefore, it does not work for clothing with narrow or spaghetti straps, for strapless clothing, and it is also unsightly when sewn or attached to a transparent clothing. Further, if one is wearing multiple underwear such as a brassiere with a chemise or camisole beneath one's clothing, the restraining strap may not have enough room to clip or restrain all these together or if it can, it causes bulging on the shoulder portion of the clothing.

The invention is not only barely visible, but it is also very thin and elastic and therefore will not loosen and slide over a person's shoulder or leave a marking when worn beneath tight fitting clothes. The straps are of varying width to suit the size and weight of the person. In brassieres, its elasticity and softness enable it to provide sufficient support to the cups, consequently prevent sagging of the breast without causing irritation on the skin.

It is therefore an object of this invention to provide a strap that is barely visible, suitable for use beneath transparent clothing.

It is also an object of this invention to provide a strap that is thin and elastic thereby clinging well to the skin to prevent unsightly markings when wearing tight fitting clothes.

It is also an object of this invention to provide a strap that won't slide over a person's shoulder.

It is also an object of this invention to provide a brassiere with thin elastic invisible straps to support the breast suitable to be worn underneath a backless, strapless clothing and clothing of transparent material.

It is also an object of this invention to provide a brassiere with an invisible back strap with and without shoulder straps that can be worn with backless clothing.

It is likewise an object of this invention to provide a backless, strapless brassiere that do not have any adhesive touching the skin which can cause allergic reactions to the wearer.

It is a further object of this invention to provide a brassiere which can give a feeling of security to the wearer that the bra will not fall off, unlike those that may detach when the adhesion fails.

It is a also a further object of this invention to provide a barely visible strap that can simply replace a regular textile strap from a convertible brassiere or underwear which allows a person to switch straps depending upon the style or material of the clothing worn thereby avoiding multiple purchases of underwears.

SUMMARY OF THE INVENTION

The invention provides a barely visible or invisible strap that can be used with underwears or undergarments, particularly those worn underneath transparent, lacey, strapless, backless or sleeveless clothing or with clothing having narrow or spaghetti straps to maintain the elegance and appearance of the clothing or apparel. The barely visible or invisible strap, comprise a strip of a longitudinal rectangular material having a first end and a second end, a connecting bracket attached to the first end and the second end, the connecting bracket having a hook on one end and a closed opening on another end for attachment to the strip of material, the material made of a clear colorless 100% polyurethane. This strap is designed to be attachable to any clothing especially brassieres with a welt like fold or loop where the connecting bracket having a hook or an adjusting bracket having an opening can attach to. An adjusting bracket may be added to the strap to provide the ability to adjust the length of the strap. The material is commercially sold under the tradename, Lastin, which is resistant to perspiration, cosmetics, oils, cleaning solvents, urine, seawater, water and light acid and do not develop a yellowish coloration with time.

DETAILED DESCRIPTION OF THE INVENTION

Figure 1:
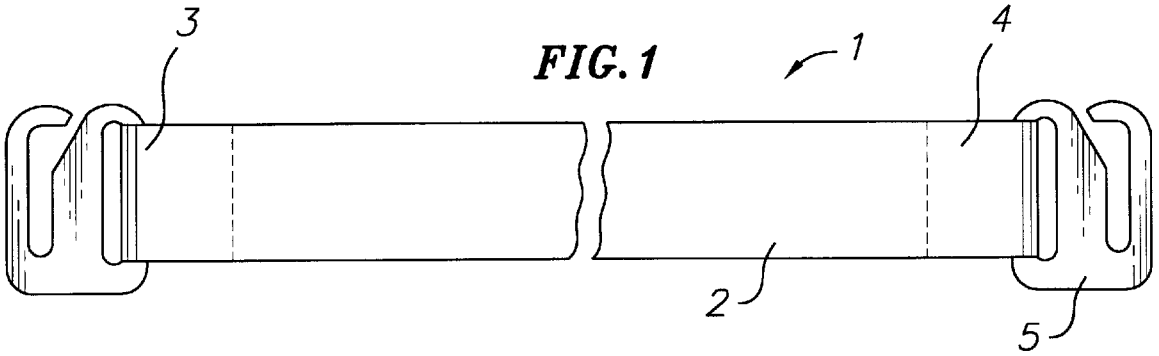
FIG. 1 is a front view of a strap.
Figure 1A:
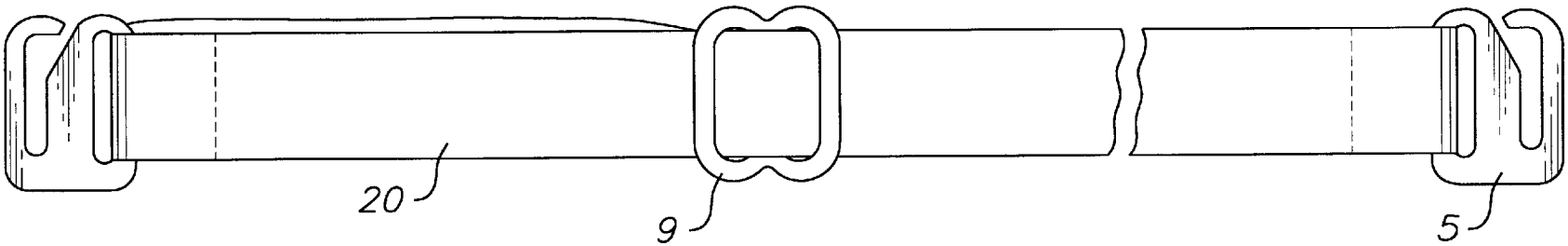
FIG. 1A is a front view of a strap with an adjusting bracket.
Figure 1B:
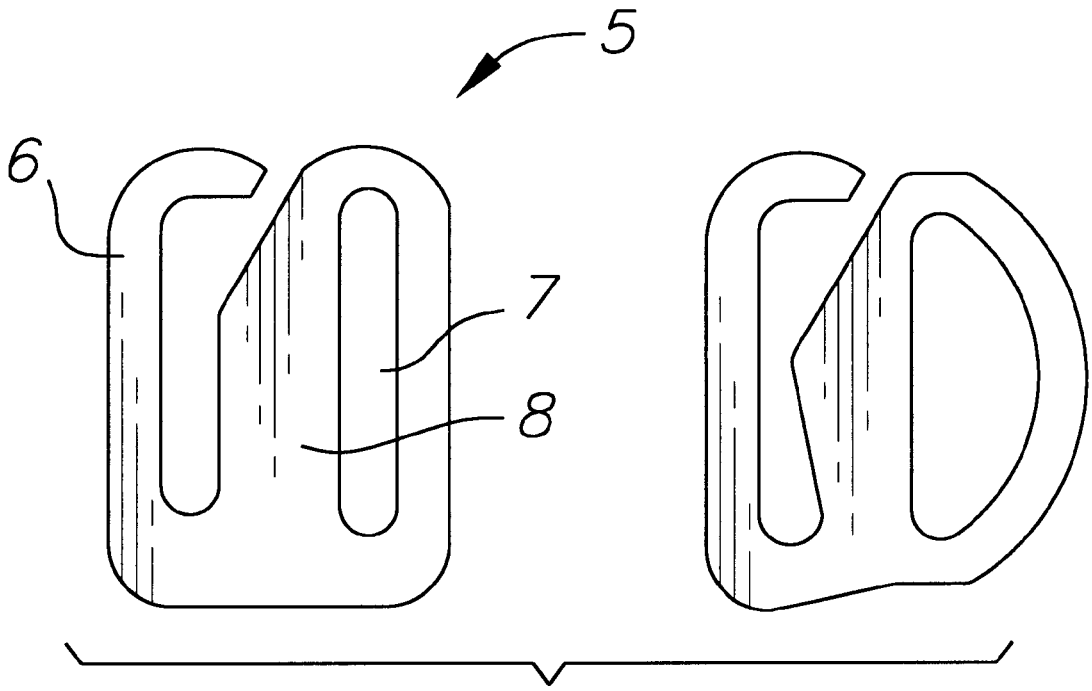
FIG. 1B is a front view of samples of connecting brackets.
Figure 1C:
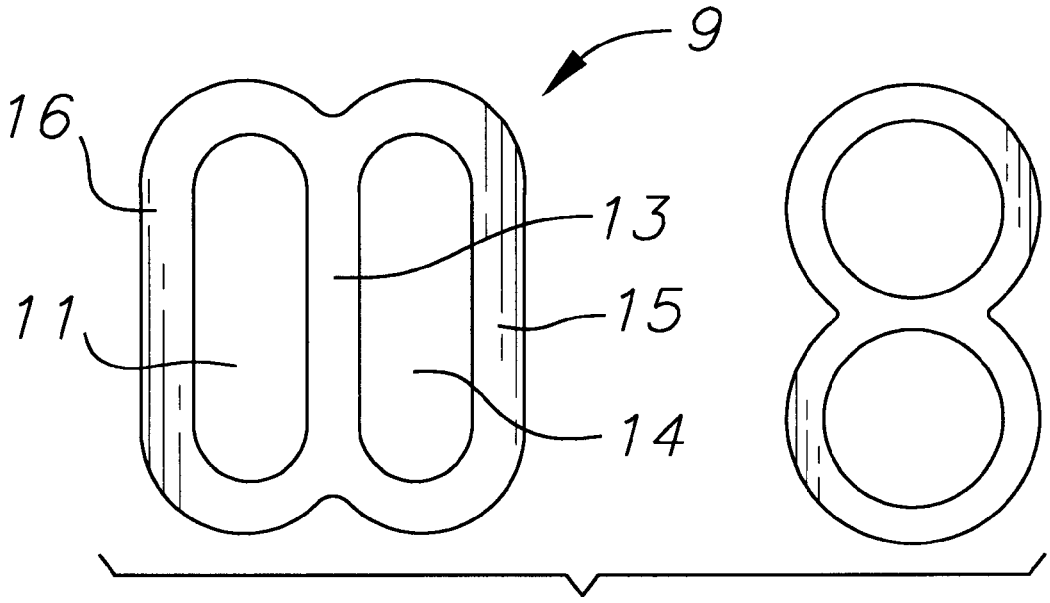
FIG. 1C is a front view of samples of adjusting brackets.

FIG. 1 shows the minimum parts of a strap 1. It is simply a longitudinal rectangular strip 2 with two ends 3 and 4. If the strap will be attached to a convertible underwear or undergarment such that it can be attached and detached at will, the strap would have a connecting bracket 5 at each end as shown in FIGS. 1 and 1A. Underwear and undergarment are used interchangeably herein. The connecting bracket 5 as shown in FIG. 1B has two ends, a hook end 6 on one end and a closed opening 7 on the other end. A divider 8 separates the hook 6 from the opening 7. If the strap is to be permanently attached to an undergarment, both ends would have an adjusting bracket 9 as shown in FIG. 1C instead of an adjusting bracket. A convertible underwear means that it has a welt like loop or fold 10 and 37 as shown in FIGS. 6A–6E, sewn usually on a border of the underwear, through which a hook end of a connecting bracket can attach to. The core of the invention lies in the material from which the strap is made from. The barely visible or invisible strap is made of 100% polyurethane, sold under the tradename, Lastin, distributed in the United States by Security Textile Corporation. The material is clear, colorless, elastic, flexible, thin and of a tensile strength suitable to stand an ordinary pull by an individual or in response to longitudinal stresses applied on the strap. This material does not acquire a yellow coloration with time. The material has the same elasticity as a standard elastic material such as garters. The elasticity is maintained at temperatures between −20° F. to 176° F. This properties allow the material to conform and adjust to the configuration of the shoulder of a wearer.

Figure 2:
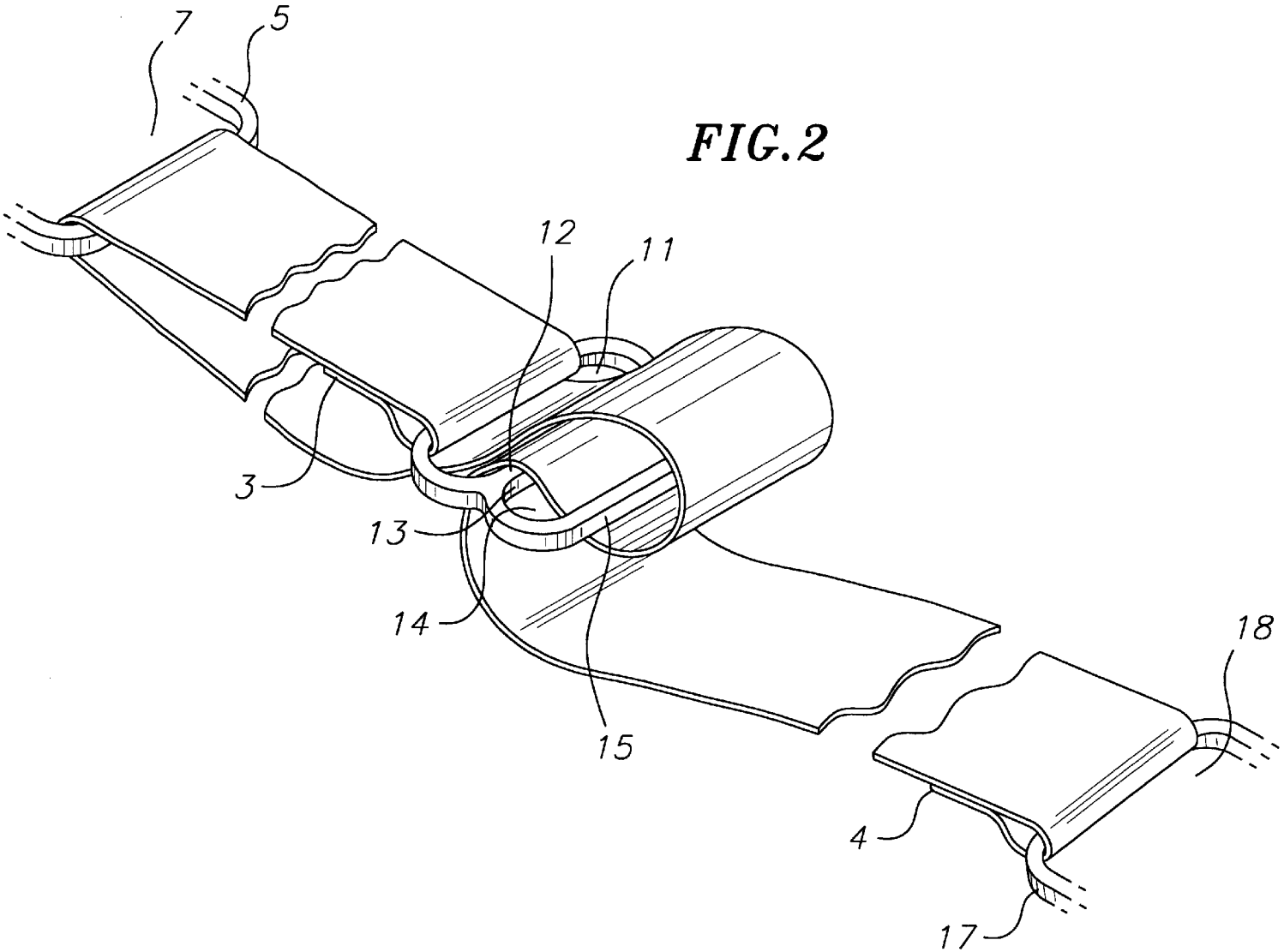
FIG. 2 is a perspective view of how the strap is looped around an adjusting bracket to keep the adjusting bracket from slippage through the strap.

Due to the different size, height, weight, and girth of a wearer, it is preferable to put an adjusting bracket 9 as shown in FIG. 1C on the strap between the location of the connecting brackets 5 as shown in FIG. 1A. An adjusting bracket 9 allows a wearer to adjust the length of the strap. Since the material is made of a thin flexible material, the strap has to be looped into the adjusting bracket 9 in a specified manner to keep the adjusting bracket from unintended slippage through the strap. As shown in FIG. 2, the strap is looped through an adjusting bracket 9 by taking one end 3 of the strap 1, before a connecting bracket 5 or another adjusting bracket is attached to a first end of the strap, and inserting this from the bottom of a first opening 11 of the adjusting bracket and over the top 12 of a divider 13 and into a second opening 14 of the adjusting bracket 9. The end 3 of the strap 1 is then wrapped around a lateral end 15 adjacent to the second opening 14 and over the top 12 and again into the first opening 11, this time from the top. This end 3 is then inserted from the bottom of a closed opening 7 of the connecting bracket 5 and out on the top and into the first opening 11 of the adjusting bracket wrapping over a lateral end 16 adjacent to the opening 11, where the end 3 is finally secured to itself by attachment to a strap portion near the lateral end 16 to close end 3. After this looping, a certain length 20 of a doubled layer strap is left between the adjusting bracket 9 and the connecting bracket 5 as shown in FIG. 1A to provide the desired length of strap for adjustment. This method of looping an adjusting bracket may also be applied to a connecting bracket, if one uses the connecting bracket to adjust the length of a strap. It is preferable to use clear, colorless connecting and adjusting brackets but opaque ones can also be used.

No special way of looping or attachment is involved with the other end 4. The other end 4 is simply connected to a second connecting bracket 17 by passing the end 4 through a closed opening 18 of the second connecting bracket 17, wrapping around a lateral end 19 (substantially hidden under the welt like loop) of the second connecting bracket 17 adjacent to the closed opening 18 where the end 4 is then glued to a strap portion near the lateral end 19 of the second connecting bracket 17 to close end 4. This latter method of attaching end 4 is the method used for attaching both connecting brackets in a strap without an adjusting bracket. In a strap without an adjusting bracket, the resulting strap is only one strip unlike those with an adjusting bracket where a double layer of strip results from the looping of the adjusting bracket to one of the connecting bracket. These brackets are commercially available and are made of either plastic or metal.

The difference in size, length, weight and girth of a wearer is also a factor considered in sizing the straps. For example, a wider, thicker strap will be more suitable for a heavier set individual. The width of the strap for this application can range from ¼ inch to 1⅛ inch. For the ¼ inch straps such as those preferably used for size A and B cups, and the ¾ inch straps for the size C and D cups, the thickness is 0.02 to 0.2 mm, preferably 0.1–0.18 mm or the thickness of a 20 pound bond white paper.

Figure 3A:
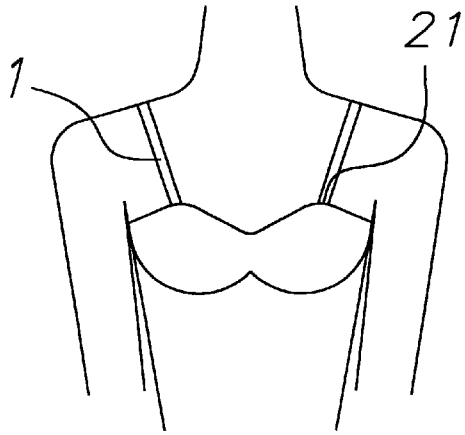
FIGS. 3A and 3B shows one way of connecting the straps on the front and back of an undergarment.
Figure 3B:
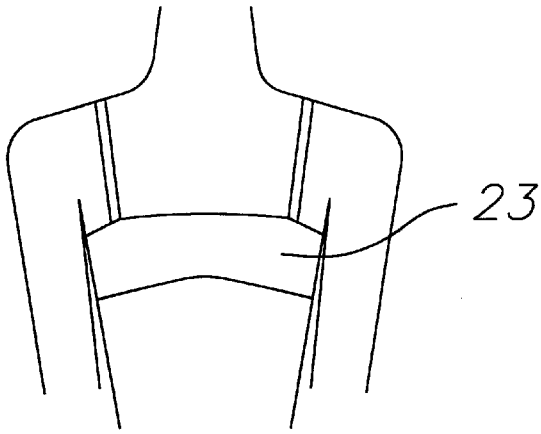
Figure 6A:
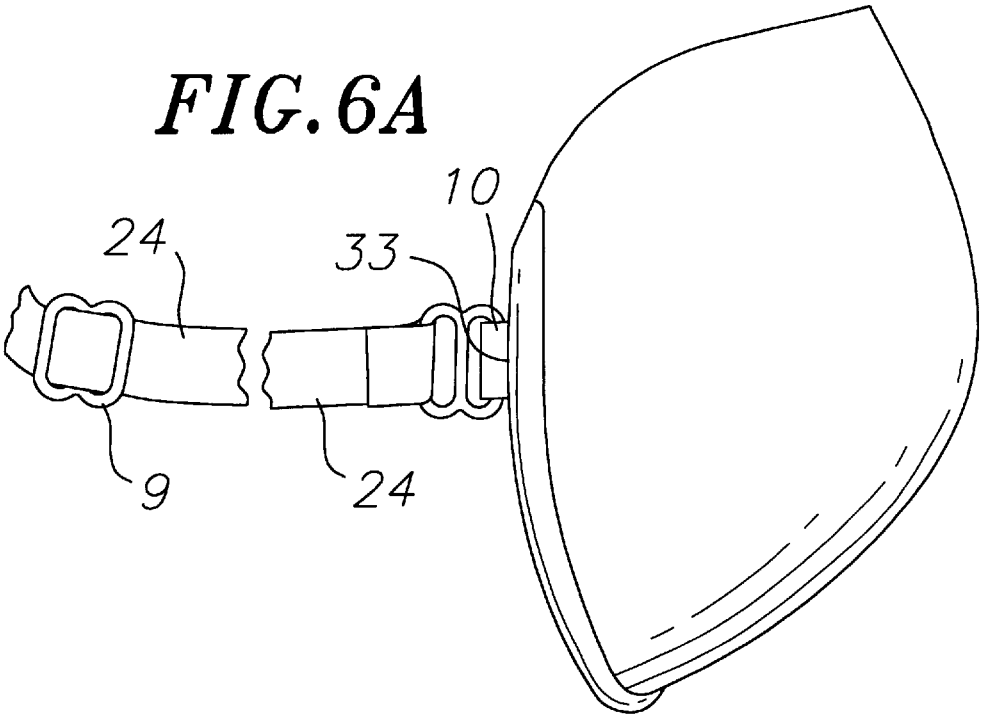
FIG. 6A is an exploded side view of a right cup of a two breast receiving cup brassiere with the invisible back straps.
Figure 6B:
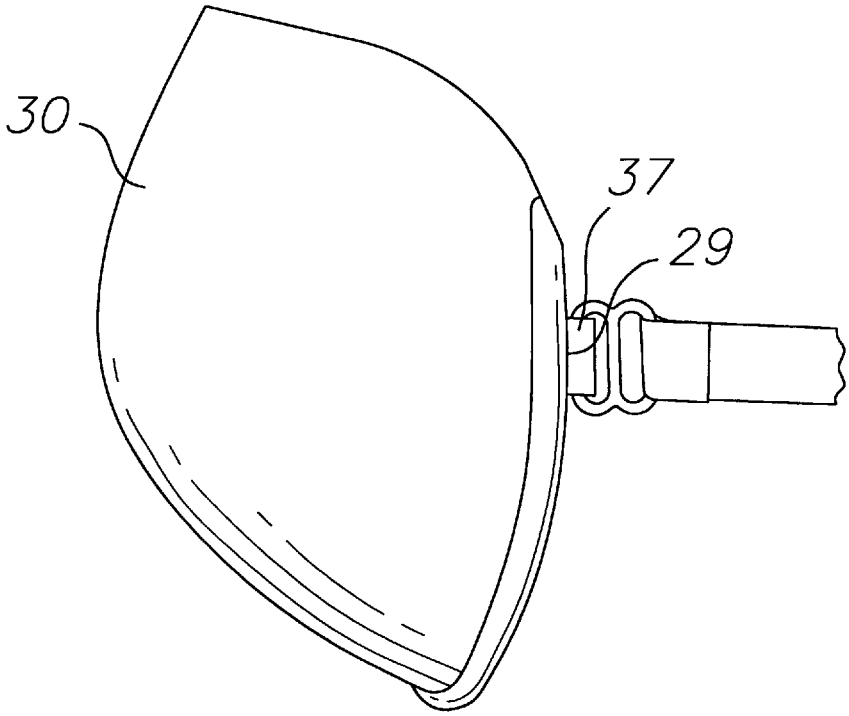
FIG. 6B is an exploded side view of a left cup of a two breast receiving cup brassiere with the invisible back straps.
Figure 6C:
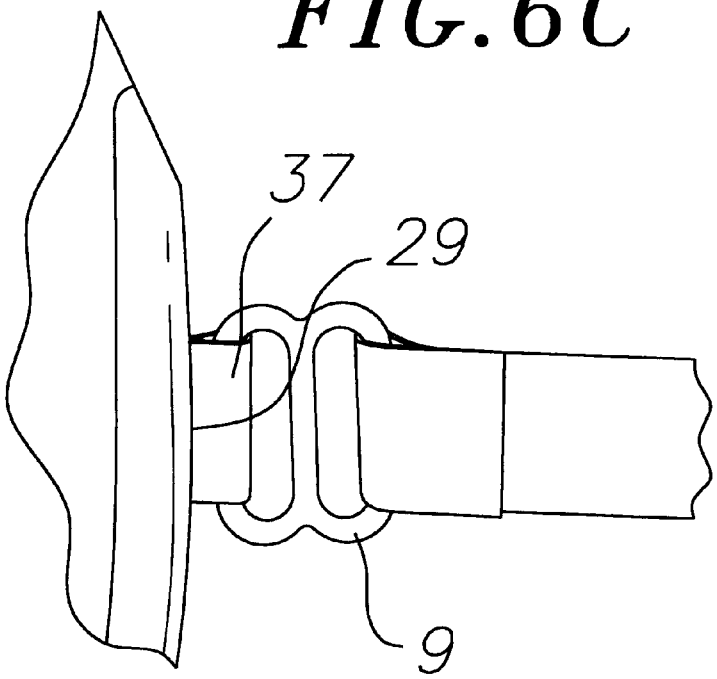
FIG. 6C is an exploded side view of how an adjusting bracket is connected to a welt like loop.
Figure 6D:
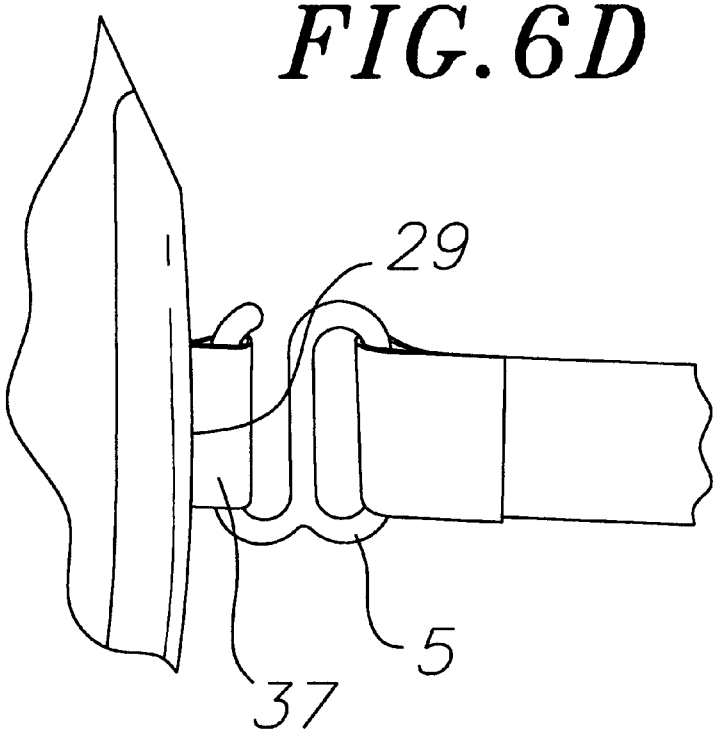
FIG. 6D is an exploded side view of how a connecting bracket is connected to a welt like loop.

The strap/s are usually attached to an undergarment, especially a brassiere in different ways. The attachment of the strap to the undergarment is through a welt like loop sewn on a desired location in the undergarment where the strap attaches to. To attach, the hook end of the connecting bracket inserts into the opening of the welt like loop as shown in FIG. 6D. Consequently, the length of the loop should conform with or be shorter than the length of the hook. One way of attachment as shown in FIGS. 3A and 3B, is the most common, where the straps 1 are a pair of vertical shoulder straps which attach and extend from a center top 21 or any top location of each frontal side above the wearer's breast, over the mid-shoulder section and down the wearer's back where they attach with a dorsal 23 part of the garment corresponding to the frontal center top 21. In the case of a bra the strap would preferably connect from the center top 22 of the bra's cup and down to a back strap 24.

Figure 4A:
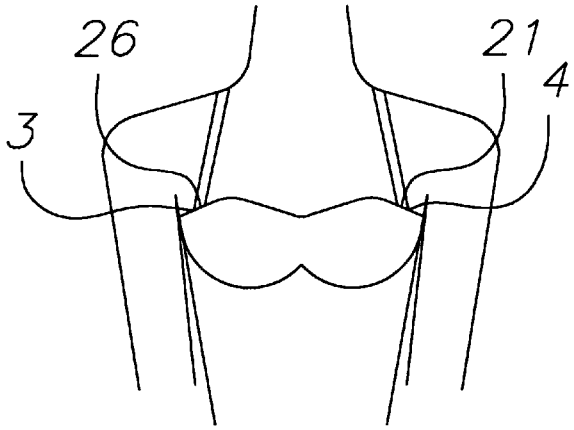
FIGS. 4A and 4B shows a second way of connecting the straps.
Figure 4B:
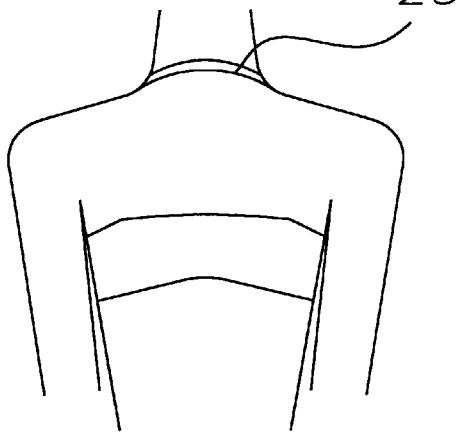

A second way of attaching the straps to an undergarment or bra as shown in FIGS. 4A and 4B, is the halter type strap where one end 3 of a strap attaches to a top border 21 above one breast, then wraps around the shoulder of the wearer and form a horizontal median 25 section across the back and down to a second center top 26 above the second breast where the second end 4 of the same strap is attached.

Figure 5A:
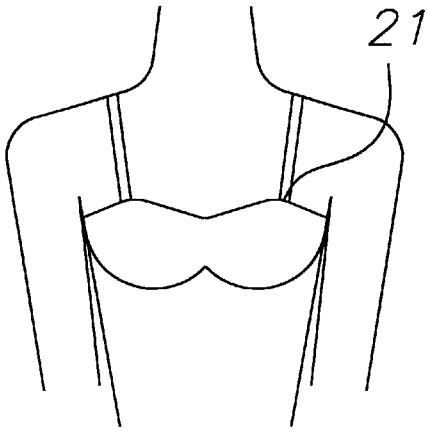
FIGS. 5A and 5B shows a third way of connecting the straps on the front and back of an undergarment.
Figure 5B:
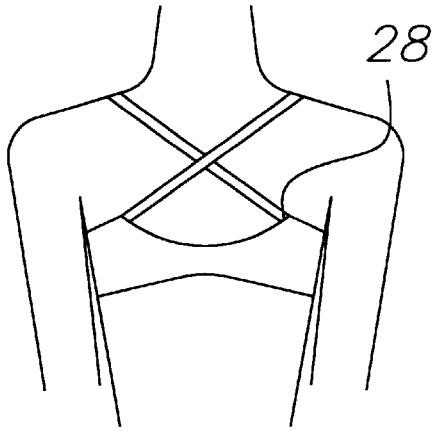

A third way of attaching the straps to an undergarment is shown in FIGS. 5A and 5B, where each ends of a pair of straps are attached to tops 21 and 26 above each left and right breasts, (in the case of a bra, this will the center tops 27 and 22 of a left and right cup respectively), which then cross the back of the wearer and pass over the shoulders such that a strap attached to the front of a left center top 21, attaches to the right 28 of the dorsal or back strap 24 of a bra and vice-versa.

Other methods of attachment are possible so long as enough strap materials are provided for a given attachment.

For underwears that are not convertible, that is, does not have a welt like loop sewn on a border, one can simply sew a welt like loop on these undergarments to be able to use the invisible straps when the proper occasion arises.

Figure 6E:
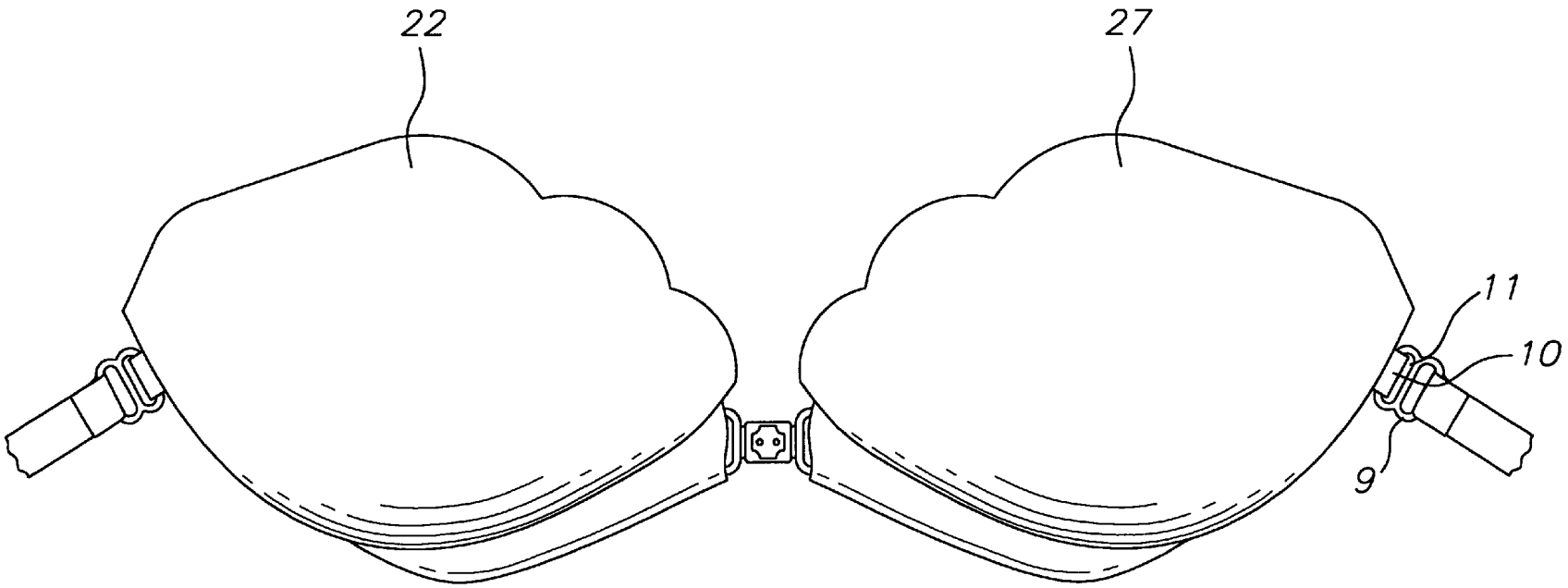
FIG. 6E is a front view of a strapless bra having a front opening with the ends of the back strap connected on each lateral side.

With the use of invisible clear colorless straps, it is also possible to strap a strapless and backless bra instead of using tapes to attach the bra to the skin of the wearer. The use of adhesive tapes pose the risk that the bra can fall off ones the adhesive has lost its adhesive capability; that the adhesive on the tapes can cause allergic skin reactions to the wearer; and that the tape can potentially be used only ones because repeat usage of a tape usually result in less adhesion. The two breast side-by-side receiving cups of a brassiere for use with these straps on backless, strapless bras, are preferably those that open in the front and have underwire beneath the cups. Brassieres that open in the front, the various devices that link the cups, as well as brassiere cups with underwire to support the breasts are known. See U.S. Pat. Nos. 5816889, 3998231, 5951365,4425689, 4393875, 4413625, 5871388 for a small sample of patents addressing these. For these brassieres as shown in FIGS. 6A–6E, a strap will connect from a welt like loop 37 sewn on a lateral side borders 29 of the left cup to a welt like loop 10 on an opposite lateral side 33 of the right cup of a two breast receiving cups of the bra, having a length from one lateral border 29 to the next 33, sufficient to accommodate the girth of a wearer measured from one lateral side 29 through the back and to the opposite lateral side 33. In the drawings, the strap would extend from the bracket shown in FIG. 6A to the other bracket shown in FIG. 6B. The strap for this purpose is referred to as back strap 24 which in this case should be made of the invisible material. A wider width is recommended for the back strap. The back strap is assembled the same way as the shoulder strap described above. The connection or attachment may be permanent or temporary. For a permanent attachment, an adjusting bracket is used as shown in FIG. 6A–6C and 6E. In this type of connection, the welt like loop 10 on the side border of a brassiere cup wrap around a lateral end of a first opening 11 of an adjusting bracket 9 before the ends of the welt like loop are sewn on the border as shown in FIG. 6A–6C. The welt like loop is usually sewn on the side border of a brassiere cup underneath an armpit of a wearer to conceal the connection. For a temporary connection, this welt like loop does not wrap around a bracket. Both ends of the welt like loop are sewn on the border without a bracket. Instead, a hook end 6 of a connecting bracket inserts into the loop 37 as shown in FIGS. 1B and 6D. In this way, the connecting bracket can be slipped in and out of the loop as desired as shown in FIG. 6D. For a brassiere cup that opens in front as shown in FIG. 6E, a permanent attachment is preferable. For brassiere cups that opens at the back, a temporary connection is preferable. These preferred means of attachment considers the ease in wearing these bras. To adjust for the different girths, it is recommended to place an adjusting bracket 9 on the back strap to control the length of the back strap 24 in the same manner that the length of the shoulder straps are controlled. The looping of the back straps into the adjusting brackets is the same as that described for the shoulder straps. An adjusting bracket is added to a back strap if it will not be unsightly or will not cause a bulge on the clothing. As in the shoulder straps, these brackets are preferably made of the same clear colorless plastic material. For women who are not comfortable with strapless bras and needs a frontal support, a shoulder strap attached in a halter type as shown in FIGS. 4A and 4B can be used. In this manner, a wearer can have the needed support on the breast to prevent any sagging.

Figure 7:
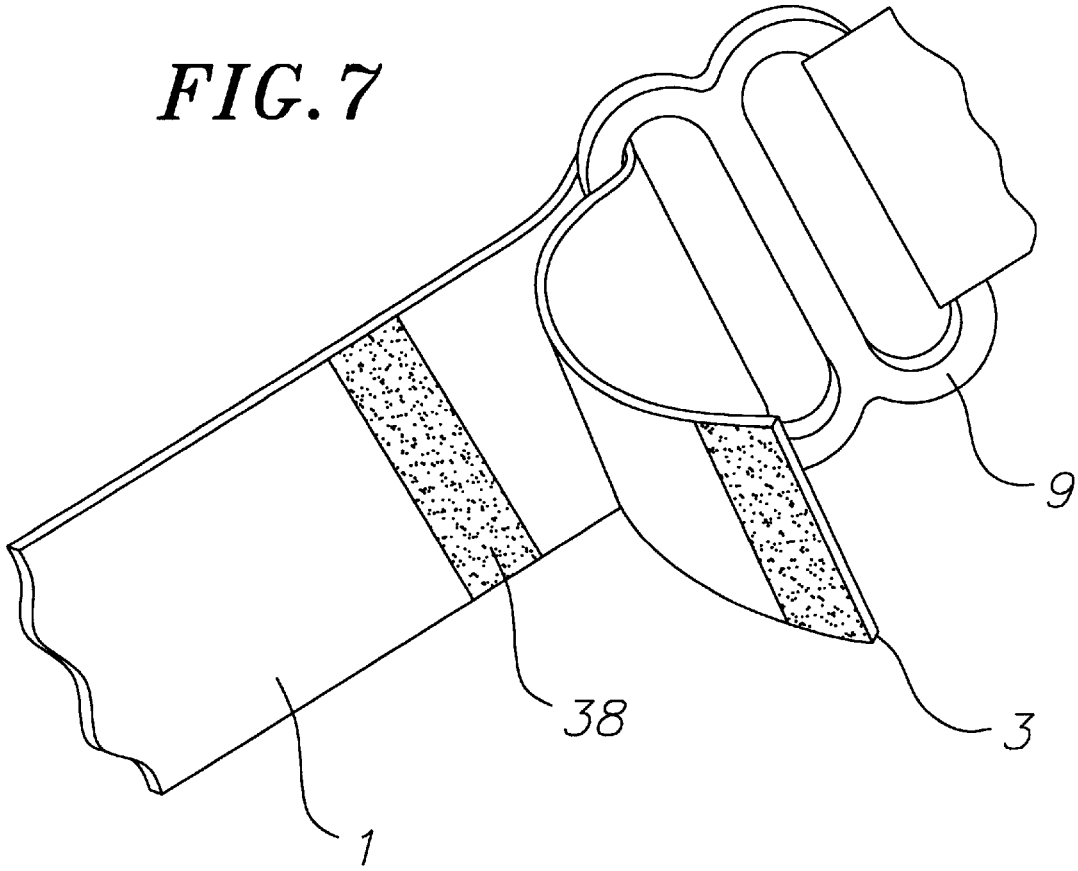
FIG. 7 shows how a loose end of a strap is adhered to a strap portion to close the end after it is looped through a bracket.

Adhering a loose end 3 of a strap 1 to a strap portion 38 proximal to a bracket after the loose end had wrapped around a lateral side of a bracket, resulting in the closure of the loose end 3, is done in several different ways as shown in FIG. 7. The shaded area denotes the areas that are adhered together. One method is through heat sealing. The polyurethane material softens at 266–284° F., melts between 356–392° F. and heat seals at 356° F. Another way is to glue the loose end with a strap portion using adhesives such as acrylic based adhesives. A primer such as acrylic polymer, chlorinated polyethylene, epoxy resins dissolved in organic solvents, may be used with an adhesive to improve adhesion. A hook and loop fastener such as VELCRO or a paper backed adhesive may also be attached to the shaded area. For the latter means of adhesion, the end of a strap is first looped around a lateral end of a bracket before they are adhered together. The paper back is removed just prior to adhering the surfaces together.

While the embodiments of the present invention have been described, it should be understood that various changes, adaptations, and modifications may be made therein without departing from the spirit of the invention and the scope of the claims.

We claim:

1. An invisible strap for an undergarment having a longitudinal rectangular strip with a first end and a second end and a connecting bracket attached to the first end and the second end, the connecting bracket having a hook on one end and a closed opening on another end for attachment to the longitudinal rectangular strip wherein the improvement comprises, a 100% polyurethane adjustable length strap having an elasticity as a standard elastic material, the elasticity maintained over a wide range of temperature.

2. The invisible strap of claim 1 wherein the adjusting bracket has a first opening, a top, a divider, a second opening, a lateral end adjacent to the first opening, a lateral end adjacent to the second opening, one end of the invisible strap inserted from a bottom of the first opening, over the top and divider and into the second opening, wrapped around the lateral end adjacent to the second opening, over the top and inserted a second time into the first opening, the end of the strap then inserted from a bottom of the closed opening of the first end connecting bracket for said invisible strap and out into the first opening of the adjusting bracket for a third insertion, then wrapping around the lateral end adjacent to the first opening, said end of the invisible strap finally secured to itself thereby forming a double layer of strap between the adjusting bracket and the first end connecting bracket.

3. The invisible strap of claim 1 wherein the hook of the connecting bracket attaches to a welt like loop sewn on a border of an undergarment when the strap attaches to the undergarment.

4. The invisible strap of claim 1 wherein an adjusting bracket having two closed opening instead of the connecting bracket is attached to the first end and the second end.

5. The invisible strap of claim 1 wherein the polyurethane is flexible, thin, of a tensile strength adapted to stand longitudinal stresses and does not acquire a yellow coloration with time.

6. The invisible strap of claim 1 wherein the strap has a width of ¼ inch to 1⅛ inches.

7. The invisible strap of claim 1 wherein the strap attaches to the undergarment in several different ways.

8. The invisible strap of claim 1 wherein the strap attaches to a welt like loop of an undergarment.

9. The invisible strap of claim 1 wherein a loose end of the strap attached to the bracket is closed by heat seal, adhesive, or hook and loop fastener.

10. A strapless shoulder, backless brassiere having an invisible back strap, comprising:

a two breast side-by-side receiving cups;

a welt like loop sewn on each opposite lateral side border of the two breast receiving cups; and, a longitudinal rectangular strip of a clear colorless plastic material having a first end and a second end, a connecting bracket attached to the first end and the second end, the first end connecting bracket having a hook on one end insertable to one welt like loop and the second end connecting bracket having a hook on one end insertable to the opposite lateral welt like loop, the strip having a length sufficient to accommodate a girth of a wearer measured from one welt like loop of one receiving cup, through a back of the wearer and to the opposite welt like loop of the second receiving cup.

11. The brassiere of claim 10 further comprising an adjusting bracket for adjusting the length of the strap.

12. The brassiere of claim 10 wherein the plastic material is clear, colorless, elastic and flexible.

13. The brassiere of claim 11 wherein the adjusting bracket has a first opening, a top, a divider, a second opening, a lateral end adjacent to the first opening, a lateral end adjacent to the second opening, one end of the invisible strap inserted from a bottom of the first opening, over the top and divider and into the second opening, wrapped around the lateral end adjacent to the second opening, over the top and inserted a second time into the first opening, the end of the strap then inserted from a bottom of the closed opening of the first end connecting bracket for said invisible strap and out into the first opening of the adjusting bracket for a third insertion, then wrapping around the lateral end adjacent to the first opening, said end of the invisible strap finally secured to itself thereby forming a double layer of strap between the adjusting bracket and the first end connecting bracket.

14. The brassiere of claim 10 further comprising a shoulder strap comprising a longitudinal rectangular strip of a clear colorless 100% polyurethane having a first end and a second end, a connecting bracket attached to the first end and the second end, the first end connecting bracket having a hook on one end insertable to a welt like loop and the second end connecting bracket having a hook on one end insertable to another welt like loop.

15. The brassiere of claim 14 further comprising an adjusting bracket for adjusting the length of the strap.

16. The brassiere of claim 15 wherein the adjusting bracket has a first opening, a top, a divider, a second opening, a lateral end adjacent to the first opening, a lateral end adjacent to the second opening, one end of the invisible strap inserted from a bottom of the first opening, over the top and divider and into the second opening, wrapped around the lateral end adjacent to the second opening, over the top and inserted a second time into the first opening, the end of the strap then inserted from a bottom of the closed opening of the first end connecting bracket for said invisible strap and out into the first opening of the adjusting bracket for a third insertion, then wrapping around the lateral end adjacent to the first opening, said end of the invisible strap finally secured to itself thereby forming a double layer of strap between the adjusting bracket and the first end connecting bracket.

17. brassiere of claim 10 wherein the back strap is permanently connected to the two breast side-by-side receiving cups.

18. The brassiere of claim 17 wherein the permanent connection uses an adjusting bracket having two lateral ends, one lateral end wrapped inside a welt like loop and the other lateral end attached to an end of the back strap.

19. The brassiere of claim 10 wherein a loose end of the back strap attached to the bracket is closed by heat seal, adhesive, or hook and loop fastener.

20. An invisible strap having an adjustable length for an undergarment, comprising:

a longitudinal rectangular strip of a clear colorless 100% polyurethane having a first end and a second end, the polyurethane having an elasticity as a standard elastic material;

a connecting bracket attached to the first end and the second end, the connecting bracket having a hook on one end and a closed opening on another end for attachment to the strip of polyurethane; and, an adjusting bracket having a special looping for adjusting the length of the strap, the adjusting bracket having a first opening, a top, a divider, a second opening, a lateral end adjacent to the first opening, a lateral end adjacent to the second opening, the special looping having one end of the invisible strap inserted from a bottom of the first opening, over the top and divider and into the second opening, wrapped around the lateral end adjacent to the second opening, over the top and inserted a second time into the first opening, the end of the strap then inserted from a bottom of the closed opening of the first end connecting bracket for said invisible strap and out into the first opening of the adjusting bracket for a third insertion, then wrapping around the lateral end adjacent to the first opening, said end of the invisible strap finally secured to itself thereby preventing the adjusting bracket from slippage through the strap and forming a double layer of strap between the adjusting bracket and the first end connecting bracket.

* * * * *